US006892933B2

(12) United States Patent
Sullivan, Jr.

(10) Patent No.: US 6,892,933 B2
(45) Date of Patent: May 17, 2005

(54) PACKAGING SYSTEM FOR SHIPPING LIQUID OR PARTICULATE MATERIAL

(76) Inventor: Joseph J. Sullivan, Jr., 114 Mann Hill Rd., Scituate, MA (US) 02066

( * ) Notice: Subject to any disclaimer, the term of this patent is extended or adjusted under 35 U.S.C. 154(b) by 186 days.

(21) Appl. No.: 10/325,508

(22) Filed: Dec. 19, 2002

(65) Prior Publication Data

US 2004/0118741 A1 Jun. 24, 2004

(51) Int. Cl.[7] ..... B65D 5/50

(52) U.S. Cl. ..... 229/122.33; 220/23.91; 229/122.32

(58) Field of Search ..... 229/122.32, 122.33, 229/164.2; 220/23.91, 495.01, 495.03; 206/594

(56) References Cited

U.S. PATENT DOCUMENTS 2,278,782 A * 4/1942 Harvey et al. ..... 229/164.2
2,339,665 A * 1/1944 Alman ..... 229/122.32
2,352,503 A * 6/1944 Walton ..... 229/131.1
2,771,184 A * 11/1956 Ryno et al. ..... 229/122.33
2,784,895 A * 3/1957 Linwood, Jr. et al. ..... 206/594
3,954,178 A * 5/1976 Mason, Jr. ..... 229/400
4,127,187 A * 11/1978 Smith ..... 229/404
4,550,854 A * 11/1985 Schellenberg ..... 229/400
4,742,951 A * 5/1988 Kelly et al. ..... 229/122.33
5,462,171 A * 10/1995 Moog et al. ..... 206/594
5,553,708 A 9/1996 Lawrence et al. ..... 206/419
5,743,393 A * 4/1998 Webb et al. ..... 206/594
6,116,422 A * 9/2000 Rabe et al. ..... 220/780
6,227,439 B1 5/2001 Hansen ..... 229/117.05
6,328,202 B1 12/2001 Giblin ..... 229/122.32

* cited by examiner

*Primary Examiner*—Gary E. Elkins
(74) *Attorney, Agent, or Firm*—Pandiscio & Pandiscio

(57) ABSTRACT

A packaging system for shipping liquid or particulate material comprises a cardboard carton, a plastic materials storage liner shaped and sized to fit in the carton, and a sleeve that surrounds and is adapted to support the liner at its top end. The liner is formed with an open top and a removable and replaceable cover is provided for the liner to prevent loss of material stored in the liner.

20 Claims, 5 Drawing Sheets

PACKAGING SYSTEM FOR SHIPPING LIQUID OR PARTICULATE MATERIAL

FIELD OF THE INVENTION

This invention relates to packaging and more particularly to a new carton and liner assembly for shipping liquid material.

BACKGROUND OF THE INVENTION

Substantially rigid plastic containers with replaceable covers, e.g., bucket-type containers, are commonly used to package and ship selected liquid materials in the nature of foods and food preparation materials, cosmetic preparations, detergents, and the like. Such containers are sturdy, typically having a wall thickness in the range of about 0.075 inch to about 0.090 inch, and have a large mouth that renders them well suited for storing and dispensing a variety of viscous liquids, e.g., syrups, mustard, and cosmetic preparations. Another mode of shipping liquid products is the "bag & box" arrangement in which a bag, made of flexible single or double ply plastic film and provided with a fitment for discharge of the bag's contents, is stored in a box made of corrugated cardboard. The latter type of packaging system is well suited for free-flowing liquids such as vinegar, wine, detergents, and the like. However, it is not well suited for viscous materials for a number of reasons. For example, it is difficult to remove all of the contents from the bag, due to the inability to scrape out the residual contents from the bag. Additionally, in the case of a material that consists of several ingredients that tend to separate from one another on standing, it is not possible to introduce a stirring implement into the bag for the purpose of mixing the contents to obtain a homogenous material. Further limitations stem from plastic recycling requirements and food packaging regulations. Environmental regulations require containers with a volume of 5gallons or less to be made of a recycleable material. Additionally governmental regulations require that plastic containers for foodstuffs be made of a virgin plastic material. The substantially rigid plastic containers comprise a relatively large amount of plastic in comparison to the flexible bags used in the "bag & box" packaging system, thereby increasing the amount of plastic that has to be disposed of or recycled. Making such containers of virgin plastic is costly and hence discourages their use for containing foodstuffs. The "bag & box" system employs less plastic, but the bags are not as sturdy as the substantially stiff containers and also cannot be used where it is essential to access all of the contents or where it is desired to mix the contents in situ.

OBJECTS AND SUMMARY OF THE INVENTION

The primary object of this invention is to provide a new and relatively inexpensive method of packaging liquid or particulate materials involving a minimal use of plastic.

Another object of this invention is to provide a new and relatively inexpensive packaging assembly or system that involves the use of paper cartons and plastic liners for containing liquid materials within the cartons.

A further object is to provide a simple and reliable packaging system that involves the use of a paper carton and a thin low cost plastic liner for the carton.

The foregoing objects are achieved by providing a rectangular or square corrugated cardboard carton, a thin flexible plastic liner shaped and sized to fit in the carton, and a sleeve that surrounds and is adapted to support the liner at its top end. The liner is provided with a removable and replaceable cover to prevent loss of the commodity stored in the liner. Other features and advantages of the invention are set forth in or rendered obvious by the following detailed description which is to be considered together with the accompanying drawings.

THE DRAWINGS

In the several figures, like parts are designated by like numerals.

DETAILED DESCRIPTION OF THE INVENTION

Figure 1:
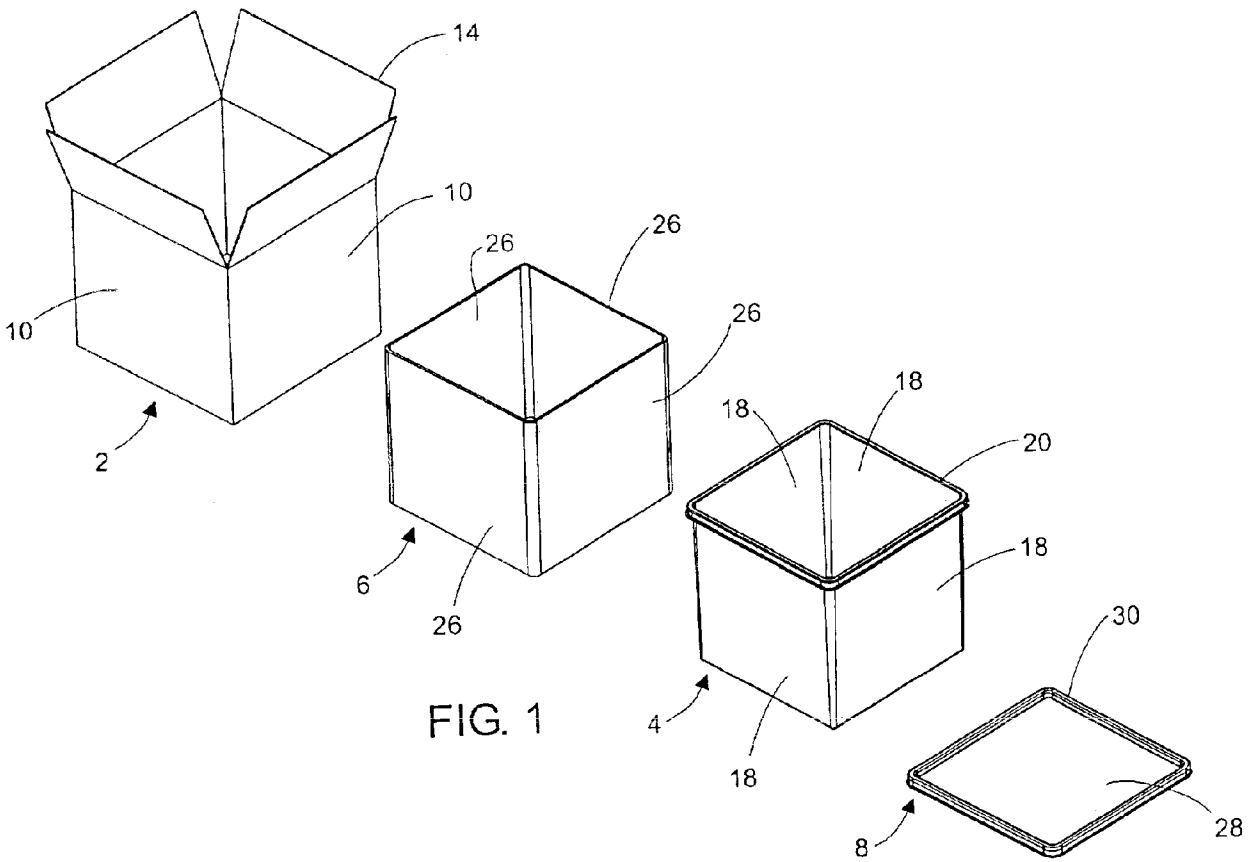
FIG. 1 is an exploded perspective view of the components of a packaging assembly constituting a preferred form of the present invention.
Figure 2:
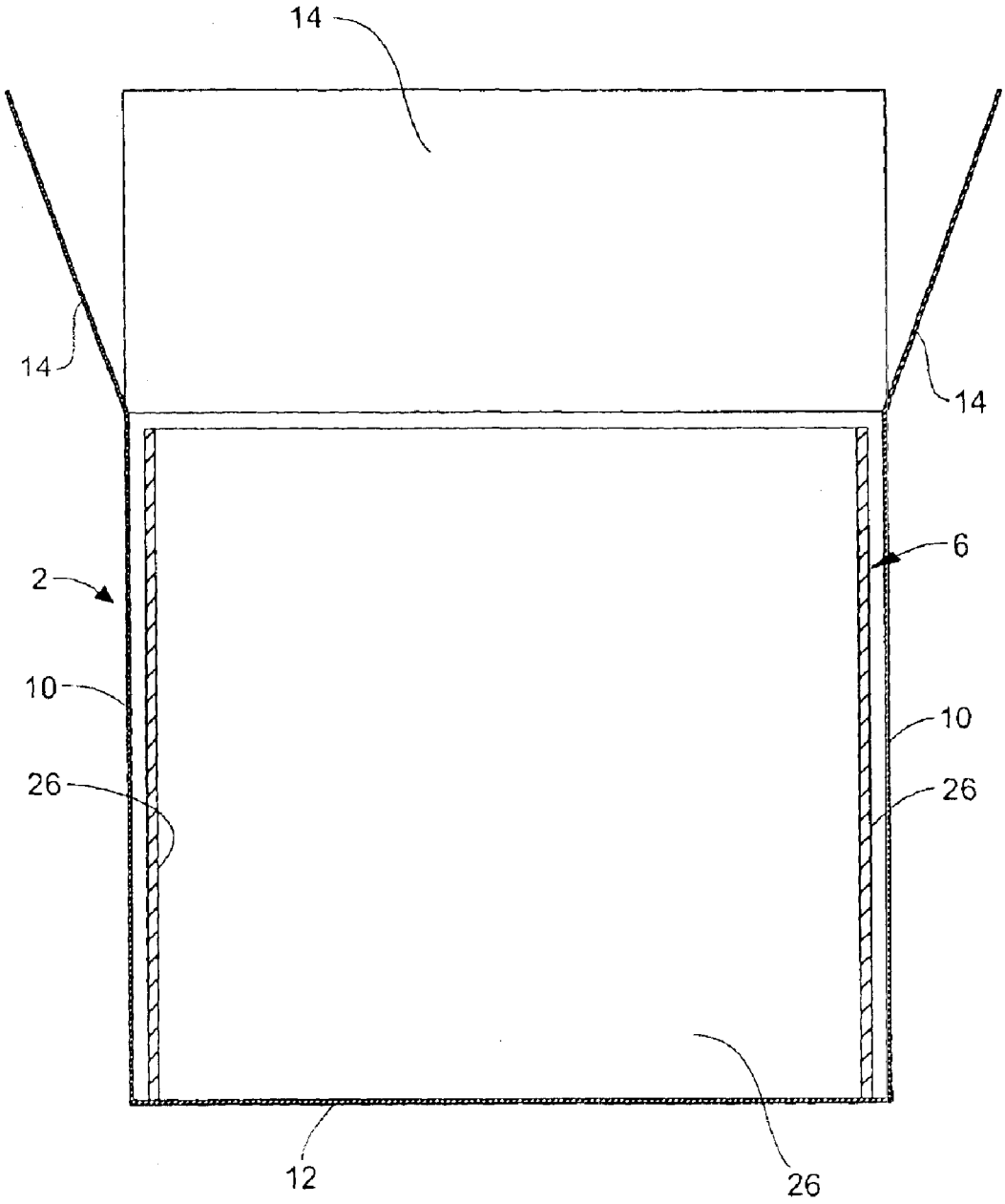
FIG. 2 is a sectional view in elevation illustrating the support sleeve for the liner disposed within the cardboard carton.
Figure 3:
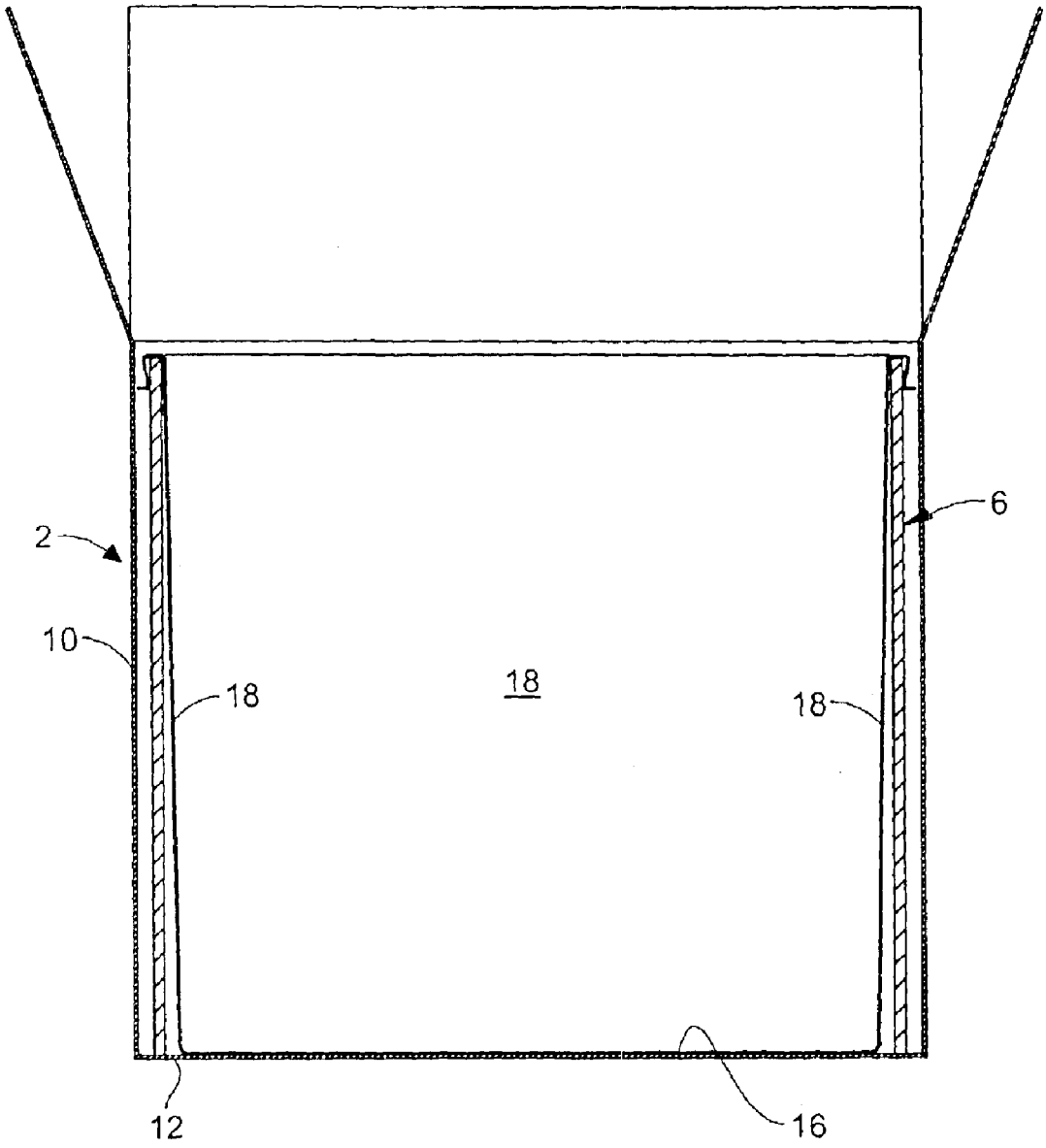
FIG. 3 is a view like FIG. 2 but with the liner disposed within and supported by the support sleeve.
Figure 4:
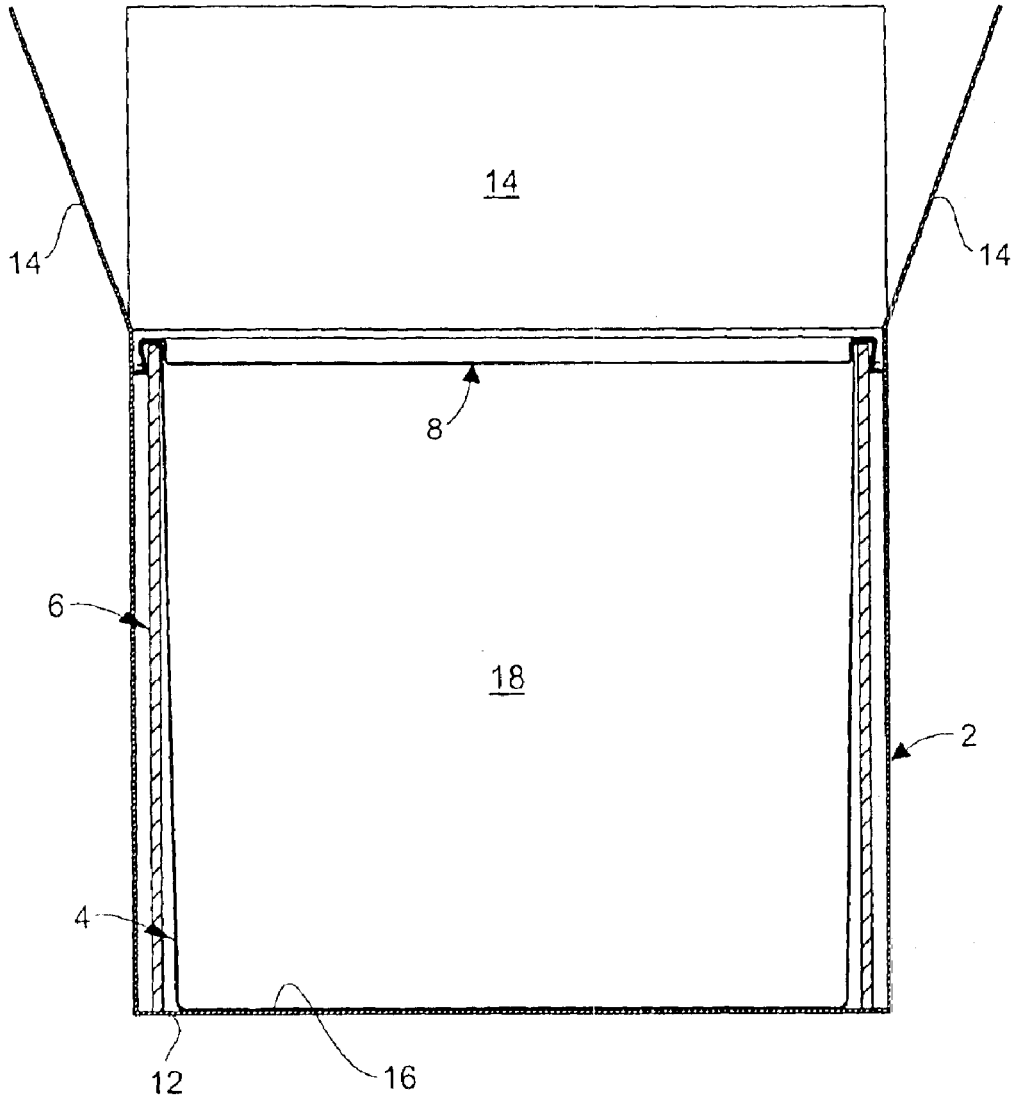
FIG. 4 is a view like FIGS. 2 and 3 but with the cover installed on the liner.

Referring to FIG. 1, the preferred embodiment of the invention comprises a conventional cardboard carton 2, a plastic liner 4, a support member 6 preferably made of cardboard, and a plastic cover 8 for the liner. As used herein the term "cardboard" is to be construed to include a conventional corrugated cardboard and a stiff paperboard. The carton 2 may have a square or rectangular cross-sectional configuration. In the illustrated embodiment the carton has a square cross-sectional shape. Carton 2 has a side wall consisting of four square or rectangular panels 10, a bottom wall 12 and an open top that is provided with flaps 14 whereby it may be closed off.

The liner 4 is made of plastic and is relatively thin, preferably having a thickness in the range of about 0.008 inch to about 0.030 inch. The liner may be made in various ways, e.g., by vacuum forming, blow molding or injection molding. By way of example but not limitation, the liner may be made of polyethylene or polypropylene. Other suitable plastic materials will be obvious to persons skilled in the art. Unlike the plastic film bags used in the "bag & box" arrangement described above, the liner is self-supporting. However, due to its thinness and flexibility, the liner is susceptible to deformation under an applied force. The liner may have a cross sectional shape similar to that of the carton. Alternatively the liner may have a circular cross-sectional configuration. In either case the liner is sized to fit within the carton. In the illustrated embodiment the liner has a square cross-sectional configuration and comprises a bottom wall 16 and a side wall consisting of four panels 18 that are similar in shape to panels 10 of the carton. However, panels 18 are slightly smaller than panels 10 so as to permit the liner to fit inside of the carton. The top end of the liner is open but is formed with a rim 20. As seen best in FIGS. 5, rim 20 consists of a radially extending flange portion 22 and a depending skirt portion 24. The rim extends fully around the perimeter of the liner, being integral extensions of the upper ends of panels 18.

The support member 6 also is made of cardboard and has a cross-sectional configuration that is similar, but not necessarily identical, to that of carton 2. It may be a closed polygonal sleeve as shown or a split polygonal sleeve. As used herein, the term "closed sleeve" means a sleeve that comprises a side wall that is continuous in a peripheral or perimeter sense, while the term "split sleeve" designates a sleeve that is split lengthwise at a selected point along its perimeter. In the latter case the ends of the split sleeve may be close to or abut one another, or may overlap one another. In the case of a closed sleeve, the sleeve is formed by bending a sheet of cardboard into the desired configuration, e.g., the square configuration shown in FIG. 1 comprising four square or rectangular panels 26, and then securing the ends of the cardboard to one another by suitable means, e.g., stapling, glue, or an adhesive tape. In any event, the sleeve is open at its top and bottom ends and is sized to fit within the carton and around the liner. However, if desired, the sleeve may be provided with a full or partial bottom wall that would underline bottom wall 16 of the liner. The height of the sleeve is set so that it is slightly less than the height of the underside of the flange portion 22 of liner rim 20, preferably about 1/32 inch to about 1/16 inch less.

Figure 6:
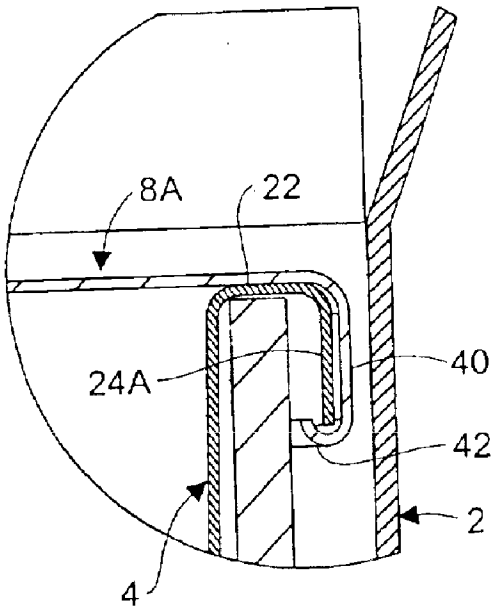
FIG. 6 is another fragmentary sectional view illustrating a second form of cover/liner connection.
Figure 5:
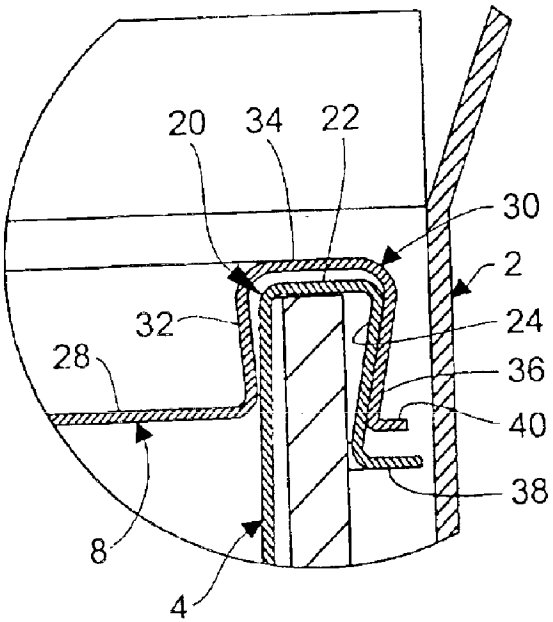
FIG. 5 is an enlarged fragmentary sectional view illustrating the cover/liner connection of the preferred embodiment of the invention.

The cover 8 is made of a resilient plastic and is shaped to fit on the liner. By way of example but not limitation, the cover may be made of the same material as the liner or some other material, and may have the same or different thickness. Polyethylene or polypropylene is preferred. The cover is provided with a rim that is designed to interlock with the rim of the liner. FIGS. 5 and 6 illustrate two different liner/cover interlocking arrangements. In the preferred embodiment shown in FIGS. 1 and 5, the cover 6 has a center portion 28 that fits within the liner and a rim 30. The latter consists of an inner wall section 32 formed integral with center portion 28, a top radially-extending section 34, and a depending lock section 36 that is slanted inwardly and downwardly as shown. Preferably, but not necessarily, the bottom ends of skirt portion 24 and lock section 36 have outwardly projecting lips 38 and 40 as shown. Preferably also cover 8 is formed so that the inner wall section 32 of cover rim 28 also is slanted inwardly and upwardly as shown, with a gap between the bottom ends of wall section 32 and lock section 36 that is less than the gap between the upper ends of wall 18 and skirt portion 24 of the liner. The cover 8 is attached to the liner by pressing it down over the liner's rim. The pressing down action results in the bottom end of lock section 36 being forced outwardly far enough to snap over the liner rim. The inherent resilience of the plastic of which the cover is made causes its rim to tightly engage inner rim 20 as shown in FIG. 5, thereby locking the cover to the liner. The advantage of the arrangement of FIG. 5 is that the center portion 28 of the cover is recessed into the liner. The cover is removed by urging it upwardly away from the liner, with the lock section 36 flexing outwardly to release the cover from the liner.

The arrangement shown FIG. 6 differs in that the plastic cover 8A is flat but has a depending skirt section 40 with an inturned lip 42 at its bottom end, and the skirt portion 24A of liner 4A extends vertically parallel to the wall of the liner rather than being inclined as in FIG. 5. The cover is locked to skirt portion 24A by lip 42. The cover is removed by pulling on lip 40 so as to flex skirt section 40 outwardly away from skirt portion 24A far enough for lip 42 clear the bottom edge of skirt portion 24A.

Figure 7:
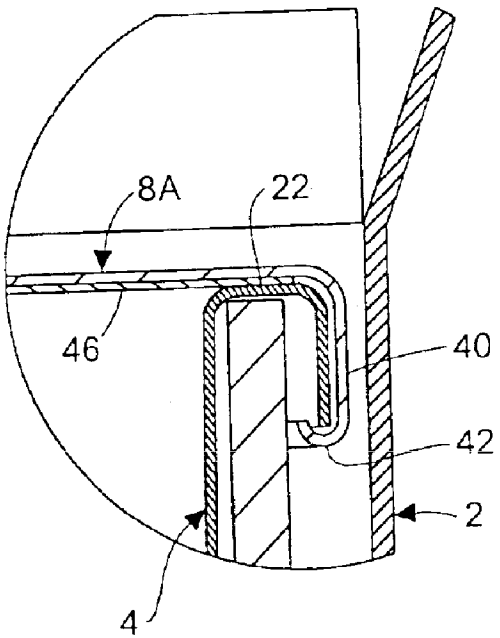
FIG. 7 is a third fragmentary sectional view illustrating the use of a sealing membrane to provide hermetic sealing of the contents of the liner.

FIG. 7 illustrates a modification of the invention that is similar to the embodiment of FIG. 6 except that it includes a sealing member 46 that is applied to the liner after it is filled. By way of example but not limitation, sealing member 46 may be a metal foil or a plastic film that is attached to the flange portion 22 by heat bonding or by use of an adhesive. The addition of sealing member 46 is preferred when the contents of the liner must be protected against moisture, air, bacteria or other materials that may have a deleterious effect on the contents.

In practice, the plastic liner may be filled with a liquid or particulate material while it is inside of carton 2. Alternatively the liner may be inserted into the carton after it has been filled. The latter practice is preferred when a sealing member 44 is to be applied. In either case, the liner is surrounded in the carton by support member 6. Preferably the support member is sized so as to fit close to the side wall of the liner, whereby to provide lateral support for the liner so that it will not deform. Additionally the support member extends close to or engages flange portion 22, thereby functioning to support the thin liner against vertical compression when the cover is applied to it.

The invention is susceptible to modifications. For example, the cover 8 may be made of a molded paperboard, e.g., like the material used to fashion molded shape egg packages. Also the mechanical interlock between the cover and liner may be modified. For example, the covers and liners shown in FIGS. 6 and 7 may be modified by downwardly and inwardly inclining the skirt portion 24A of the liner and the skirt section 40 of the cover, so as to provide a locking action similar to that of the embodiment of FIG. 5. In the case where the liner has a circular cross-sectional shape, the support member 6 will have the same shape with an inner diameter that is close to but slightly larger than the outer diameter of the liner. Another form of liner/cover mechanical interlock involves replacing the rim 20 of the liner with a circumferentially-extending, radially-projecting rib and replacing the rim 30 of the cover with a rim that has a circumferentially-extending groove shaped to make a snap fit interlock with the rib on the liner, or reversing that scheme so that the cover has an inwardly projecting rib and the liner has a groove sized to accept that rib in a snap fit. Still other modifications will be obvious to persons skilled in the art.

A carton/support member/liner/cover arrangement as herein disclosed may be used to package a variety of materials. A further advantage is that the invention is easy to implement. Another advantage is that the support sleeve 6 allows the use of a thin flexible liner to accommodate either liquids or solids. A further advantage is that if only some of the contents are consumed, the remainder can be protected by re-attaching the cover to the liner. Application of the invention to commercial use also is facilitated by the fact that the carton, support member, liner and cover may be made in different sizes. A further advantage is that the open liner and its cover may be cleaned and re-used. Most importantly, the amount of plastic required to implement the invention is relatively small, far less than is used in making the substantially rigid plastic containers referred to above and comparable to the amount of plastic required for the "bag & box" packaging system, thereby minimizing the amount of plastic required to be recycled. Moreover, if the liner is required to be made of virgin plastic in order to accommodate an edible food material, the cost of the liner will be acceptable due to the relatively small amount of plastic required to make it. Although the invention was conceived for the purpose of packing liquids, it may also be used to package particulate material, e.g., drug capsules, food particles, and the like. Still other advantages will be obvious to persons skilled in the art.

What is claimed is:

1. A packaging assembly for holding liquids or particulate material comprising:

a cardboard container having side and bottom walls, an open top end and foldable flaps for closing off said top end;

a self-supporting plastic liner for containing liquids or particulate material disposed in said container, said liner comprising a side wall, a closed bottom end characterized by a bottom wall formed integral with said side wall, and an open top end having an outwardly-projecting rim, said rim comprising a radially-extending flange portion;

a liner support member comprising a sleeve having top and bottom ends disposed in said container in surrounding relation to said liner, said support member resting on and supported by said bottom wall of said container with said top end of said sleeve underlying and being proximate to said flange portion of said rim in in position to support said liner against vertical compression; and a cover for closing off said open top end of said plastic liner, said cover having a peripheral portion that is adapted to interlock with said liner, whereby to keep said cover attached to said liner.

2. A packaging assembly according to claim 1 wherein said peripheral portion of said cover is adapted to interlock with said rim whereby to keep said cover attached to said liner.

3. A packaging assembly according to claim 1 wherein said container has a side wall consisting of a plurality of interconnected panels that form a rectangular or square configuration in plan view.

4. A packaging assembly according to claim 3 wherein said liner and sleeve have a rectangular or square configuration in plan view.

5. A packaging assembly according to claim 4 wherein said wall of said liner is close to said sleeve.

6. A packaging assembly according to claim 1 wherein said rim comprises a depending skirt portion formed integral with and surrounding said radially-extending portion, and said peripheral portion of said cover is shaped to fit over and make a tight connection with said rim.

7. A packaging assembly according to claim 6 wherein said peripheral portion of said cover makes a snap fit with said second depending skirt portion of said rim.

8. A packaging assembly according to claim 6 wherein said peripheral portion of said cover comprises a radially-extending section and a depending lock section, and further wherein said radially-extending section extends over said first radially-extending portion of said rim and said depending lock section extends under and is locked to said second depending skirt portion of said rim.

9. A packaging assembly according to claim 1 wherein said liner rests on and is supported by said bottom wall of said container.

10. A packaging assembly according to claim 1 wherein said liner support member is made of cardboard.

11. A packaging assembly according to claim 1 wherein said sleeve is split along its length.

12. A packaging assembly according to claim 1 wherein said liner is flexible and has a wall thickness in the range of about 0.008 inch to about 0.030 inch.

13. A packaging assembly according to claim 8 wherein said lock section is slanted inwardly and downwardly.

14. A packaging assembly according to claim 13 wherein said lock section and said skirt portion of said rim have outwardly projecting lips at their bottom ends.

15. A packaging assembly according to claim 8 wherein said skirt portion has a bottom edge, and said depending lock section has an inturned lip at its bottom end that extends under said bottom edge of said skirt portion.

16. A packaging assembly according to claim 8 further including a moisture impermeable sealing member interposed between said liner and said cover, said sealing member being sealed to and closing off said open top end of said liner.

17. A packaging assembly for holding liquids or particulate material comprising:

a cardboard box having a side wall comprising four rectangular panels, a bottom end closed off by a bottom wall, and an open top end, and foldable flaps attached to said panels for closing off said open top end;

a self-supporting plastic liner for containing liquids or particulate material disposed in said box, said liner comprising a side wall, a closed bottom end characterized by a bottom wall formed integral with said side wall, and an open top end having an outwardly-projecting rim, said liner resting on said bottom wall of said container;

a liner support member comprising a sleeve comprising a side wall and top and bottom ends disposed in said box in surrounding relation to said liner, said top end of said sleeve underlying said rim in supporting relation to said liner; and a cover for closing off said open top end of said plastic liner, said cover having a peripheral portion that is adapted to extend and interlock with said rim, whereby to keep said cover attached to said liner.

18. A packaging assembly according to claim 17 wherein said liner and sleeve have a circular cross-sectional configuration, and said sleeve lies close to the side wall of said liner.

19. A packaging assembly according to claim 17 wherein said liner and sleeve have a polygonal cross-sectional configuration, and said sleeve lies close to the side wall of said liner.

20. A packaging assembly according to claim 17 wherein said side and bottom walls of said liner are thin and flexible.

* * * * *

UNITED STATES PATENT AND TRADEMARK OFFICE

CERTIFICATE OF CORRECTION

PATENT NO. : 6,892,933 B2
DATED : May 17, 2005
INVENTOR(S) : Joseph J. Sullivan, Jr.

It is certified that error appears in the above-identified patent and that said Letters Patent is hereby corrected as shown below:

Column 5,
Line 44, insert "flange" after -- radially-extending --;
Line 54, delete "first";
Line 55, delete "second";

Column 6,
Line 44, insert -- over -- after "extend".

Signed and Sealed this

Twelfth Day of July, 2005

JON W. DUDAS
*Director of the United States Patent and Trademark Office*